US006206792B1

(12) United States Patent
Tavares et al.

(10) Patent No.: US 6,206,792 B1
(45) **Date of Patent: *Mar. 27, 2001**

(54) GOLF BALL HAVING ELONGATED DIMPLES AND METHOD FOR MAKING THE SAME

(75) Inventors: Gary Tavares, Sturbridge; Kevin Shannon, Longmeadow; Daniel Murphy, Chicopee; Joseph F. Stiefel, Wilbraham, all of MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/285,698

(22) Filed: Apr. 5, 1999

Related U.S. Application Data

(63) Continuation-in-part of application No. 08/869,981, filed on Jun. 5, 1997, now Pat. No. 5,890,975.

(51) Int. Cl.[7] ..... A63B 37/12; A63B 37/14

(52) U.S. Cl. ..... 473/378; 473/378; 473/379; 473/380; 473/381; 473/382; 473/384; 473/383

(58) Field of Search ..... 473/378–384

(56) References Cited

U.S. PATENT DOCUMENTS

| | | | | |
|---|---|---|---|---|
| 4,869,512 | * | 9/1989 | Nomura | 273/232 |
| 4,979,747 | * | 12/1990 | JonKouski | 273/232 |
| 5,018,741 | * | 5/1991 | Stiefel | 273/232 |
| 5,087,048 | * | 2/1992 | Sun | 273/232 |
| 5,143,377 | * | 9/1992 | Oka | 273/232 |
| 5,192,078 | * | 3/1993 | Woo | 273/232 |
| 5,192,079 | * | 3/1993 | Sun | 273/232 |
| 5,273,287 | * | 12/1993 | Molitor | 273/232 |
| 5,301,951 | * | 4/1994 | Morell | 273/232 |
| 5,308,076 | * | 5/1994 | Sun | 273/232 |
| 5,332,226 | * | 7/1994 | Kim | 273/232 |
| 5,356,150 | | 10/1994 | Lavallee et al. . | |
| 5,377,989 | * | 1/1995 | Machin | 273/232 |
| 5,406,043 | * | 4/1995 | Banji | 219/69.17 |
| 5,722,903 | | 3/1998 | Moriyama et al. . | |
| 5,890,975 | * | 4/1999 | Stiefel | 473/384 |

FOREIGN PATENT DOCUMENTS

| | | |
|---|---|---|
| 2327890 | 2/1999 | (GB) . |

* cited by examiner

*Primary Examiner*—Lee Young
*Assistant Examiner*—Paul Kim
(74) *Attorney, Agent, or Firm*—Laubscher & Laubscher

(57) ABSTRACT

A spherical ball and a method of making the spherical ball wherein the ball has a plurality of elongated dimples substantially covering the outer surface of the ball without any dimple overlap. The elongated dimples are of at least two types including a first plurality of dimples having a minor axis and a major axis which together form the long axis of the first plurality of dimples. The minor axis being less than the major axis. A second plurality of dimples has a minor axis equal to that of the first plurality of dimples and a major axis less than the major axis of the first plurality of dimples but greater than the minor axis.

4 Claims, 6 Drawing Sheets

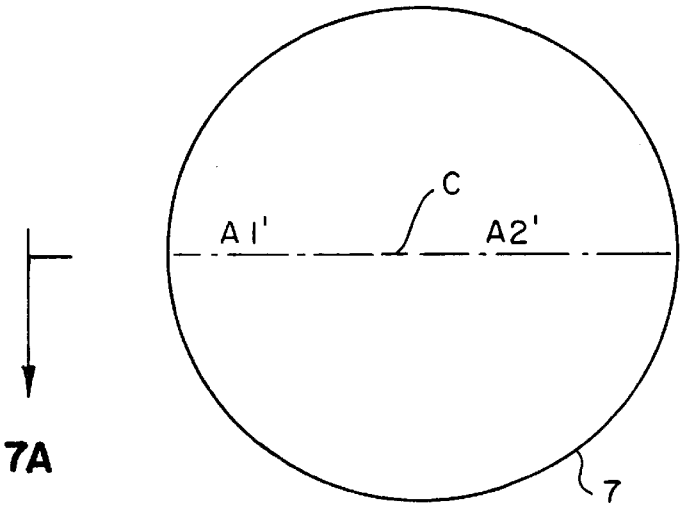
FIG. 7
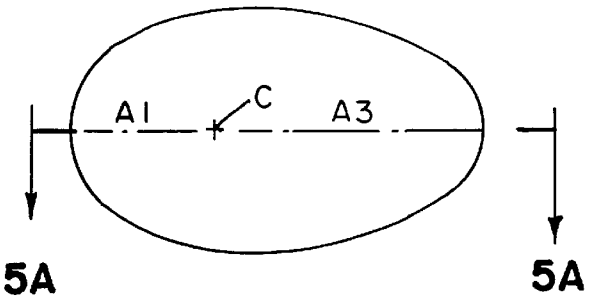
FIG. 5
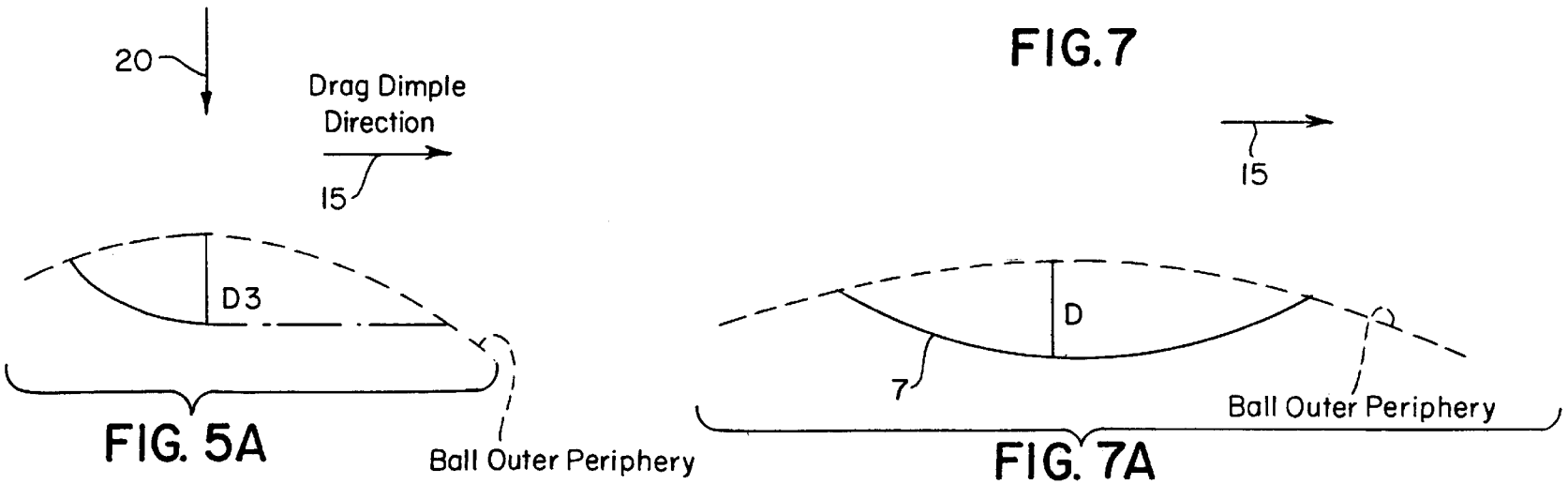
FIG. 7A
FIG. 5A

GOLF BALL HAVING ELONGATED DIMPLES AND METHOD FOR MAKING THE SAME

This application is a continuation-in-part of U.S. application Ser. No. 08/869,981 filed Jun. 5, 1997, now U.S. Pat. No. 5,890,975.

This invention relates generally to the dimple configuration on the surface of a golf ball and more particularly to an elongated dimple configuration and the method of obtaining that configuration.

BACKGROUND OF THE INVENTION

Golf balls are now being produced having various dimple patterns, dimple sizes, and geometric dimple patterns. Generally speaking, all of these dimples are configured so as to have a substantially constant geometric surface. Whether circular or multi-sided, the dimples are designed so that the geometrical configuration of each dimple is substantially the same regardless of its size. In this type of dimple arrangement, the dimples are normally configured in some pattern such as an octahedron, dodecahedron, or the like, or are configured so as to provide sections within the hemisphere, whether those sections number four, or six, or whatever desired configuration. Normally, the dimples are arranged in a desired pattern within each section and then this pattern is repeated for each section. The standard procedure is that each hemisphere has the same number of dimples and in substantially the same pattern and the hemispheres may be rotated with respect to each other depending upon the position of the mold halves.

U.S. Pat. No. 5,356,150 issued Oct. 18, 1994 and assigned to the assignee of the present invention discloses a golf ball having a plurality of dimples formed on the spherical surface of the golf ball, with the surface defining opposite poles and an equator midway between the poles so as to divide the surface into two hemispheres. The hemispheres have substantially the same dimple pattern and each dimple pattern comprises a dimple-free area surrounding the pole, a dimple-free area adjacent the equator, and a plurality of substantially identical sections extending between the pole and the equator, with each of said sections having a dimple pattern which comprises a plurality of elongated dimples. The axis of each dimple may extend in a direction between a line parallel with the equator and a line between the equator and the pole. The majority of the dimples overlap at least one adjacent dimple. The method used for obtaining this pattern is to locate a plurality of substantially similar geometric dimples on each of the hemispheres and move the outline of the dimples tangentially along the surface of the ball in the selected direction until it passes beyond the spherical surface so as to form elongated dimples in the surface of the ball.

SUMMARY OF THE INTENTION

The present invention is an improvement over the ball disclosed in U.S. Pat. No. 5,356,150 in that it improves the aerodynamics of that ball. It has been found that the use of a dimpled surface where substantially all of the dimples overlap does not necessarily have the optimum aerodynamic characteristics during the flight of the ball. The present invention may be formed by the basic movement as set forth in the above-described patent and uses at least two different sizes of elongated dimples with substantially no dimple overlap. In order to obtain substantially maximum dimple coverage of the surface of the ball a first set of dimples are provided which are formed by extending the dimple depression in a selected direction which may extend until it terminates as it leaves the surface of the ball. For the purposes of clarification, this movement will be referred to as full dimple drag. A second set of dimples are provided by using a dimple drag less than the full distance described above which will be referred to as partial dimple drag. This second set of elongated dimples permit the use of shorter elongated dimples which provides a substantial dimple coverage with substantially no dimple overlap. Additional elongated dimples may be added using dimple depressions of differing diameters and depths. Further, a pattern may include dimples having different partial drag lengths.

According to another object of the invention, elongated dimples may be formed by drilling into a spherical surface to a first depth with a drill bit having a first radius and by displacing the drill bit and/or the spherical surface in a first direction during the drilling step. The first direction may be either straight or curved. In addition the drill bit and/or the spherical surface may be further displaced in a second direction during the drilling step to form an elongated dimple with two axes.

BRIEF DESCRIPTION OF THE DRAWINGS

FIGS. 5 and 5A show a plan and cross-sectional view of an elongated dimple formed by having a full dimple drag;

FIGS. 7 and 7A show a plan and cross-sectional view of a further elongated dimple formed by having a partial dimple drag;

DETAILED DESCRIPTION OF THE PREFERRED EMBODIMENT

Figure 1:
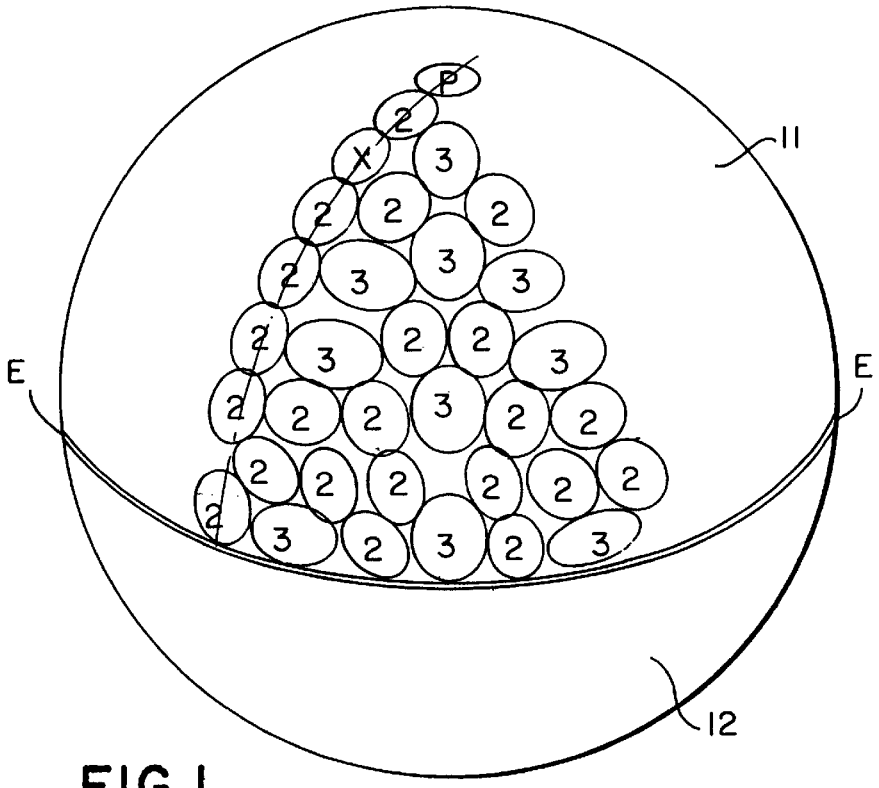
FIG. 1 is a perspective off-equator view showing a basic dimple pattern section which is repeated about the surface of the ball in each hemisphere.

FIG. 1 shows the basic pattern used to develop the dimple coverage in one example of the present invention. The ball is divided into two hemispheres 11 and 12 divided by a dimple free equator E—E. A basic pattern section is shown on hemisphere 11. The pattern shows two different dimples 2 and 3 which will be described in detail below.

Figure 2:
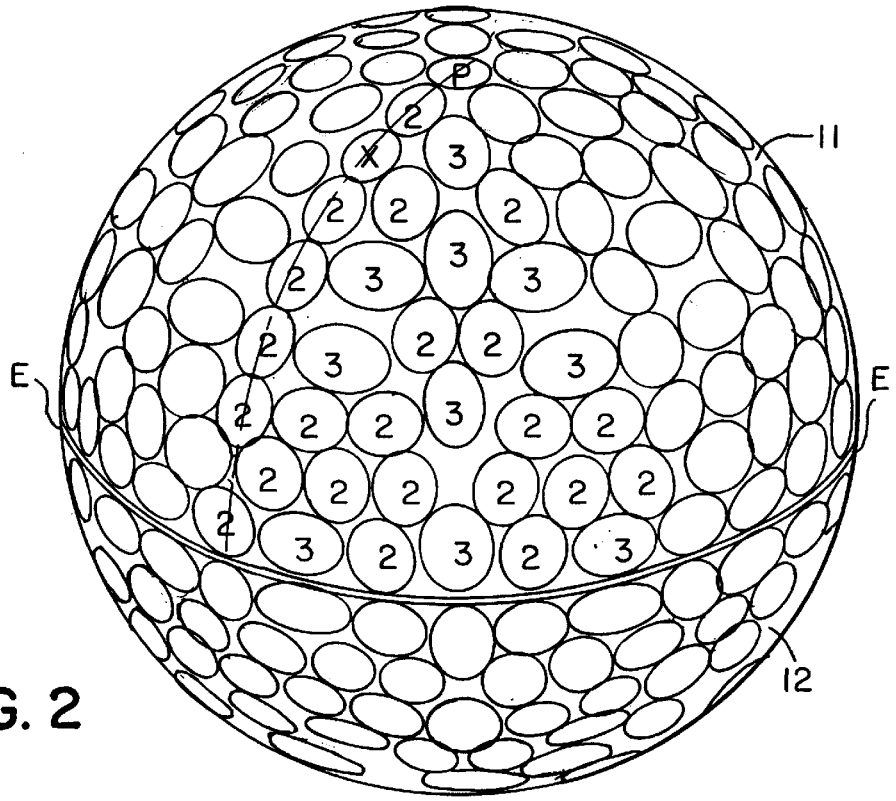
FIG. 2 is a perspective off equator view showing a finished ball incorporating the pattern of FIG. 1.

FIG. 2 is an off-equator view of a finished ball where substantially all of the dimples are different dimples 2 and 3. As can be seen, a ball is provided which has substantially no dimple overlap. By creating dimples 2 by partial dimple drag, it is possible to increase the percent dimple coverage over the coverage obtained using circular dimples in combination with elongated dimples 3 formed by full dimple drag since the surface area between dimples is reduced.

This pattern of FIG. 1 is repeated five times about the surface of hemisphere 11 except that all repeating patterns share a common pole dimple. This same pattern appears on hemisphere 12.

All of the elongated dimples 2 are substantially identical and all of the elongated dimples 3 are substantially identical. The specific configuration of these dimples is discussed below.

Dimples X are formed by the five core pins in each hemisphere which support the core within the mold while the cover is being formed. Due to the position of the core pins and the manner of their creation, dimples X are elliptical. The two polar dimples P are formed by vent pins during the formation of the cover and are substantially circular. Each key pattern includes 33 dimples plus the common pole dimple P which, when duplicated completely over the ball in the manner described above, results in a ball having a total of 332 dimples as shown in FIG. 2.

Figure 3:
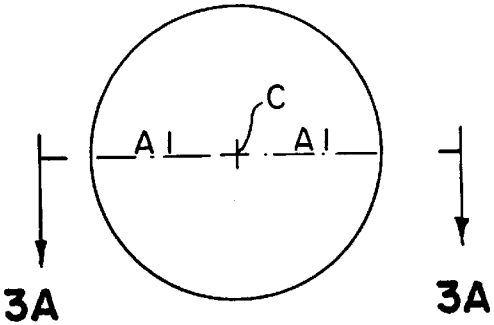
FIGS. 3 and 3A show a plan view and a cross-sectional view of a basic circular dimple.
Figure 3A:
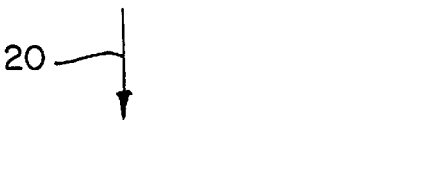
Figure 3A:
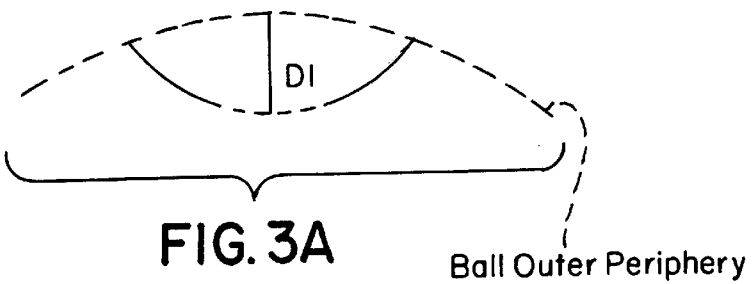

FIGS. 3, 3A, 4, 4A, and 5, 5A illustrate the progression of dimple formation as used in the present invention. FIG. 3 is an illustration of a circular dimple as used on most golf ball surfaces at the present time. This dimple has a constant radius. Thus, the two axes A1 are equal. Arrow 20 indicates the initial direction of the drill which is used to form the dimple in 3A. The drill (not shown) extends into the spherical ball outer periphery at point C until the desired depth D1 is reached.

Figure 4:
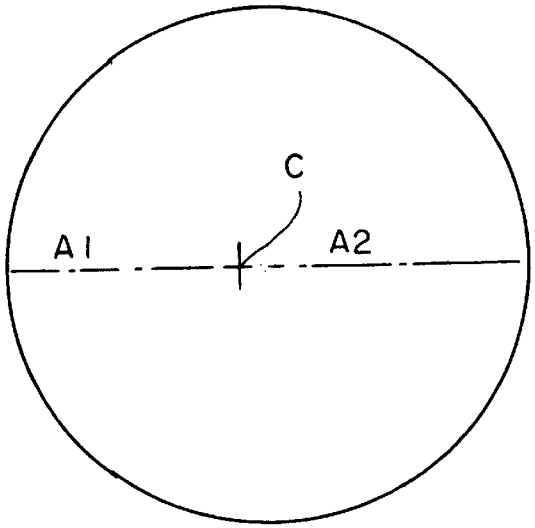
FIGS. 4 and 4A show a plan and cross-sectional view of an elongated dimple formed by having a partial dimple drag.
Figure 4A:
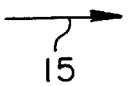
Figure 4A:
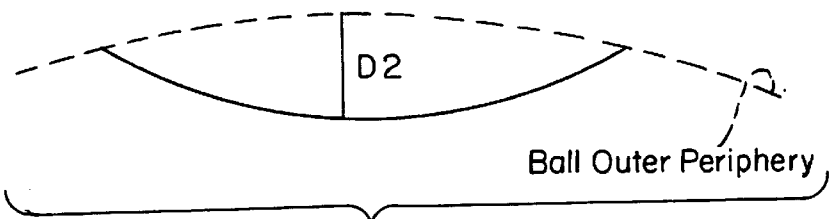

FIG. 4 illustrates dimple 2 of FIG. 1. Again the dimple is formed to the desired depth D2. Since the formation of this dimple starts with a circular dimple as in FIG. 3, the minor axis A1 is the same as the radius of the circular dimple. Dimple drag as discussed above, is in the direction indicated by arrow 15. In the illustration of FIG. 4, partial dimple drag results in major axis A2 which is greater than axis A1.

FIG. 5 illustrates dimple 3 of FIG. 1 which has been formed using a full dimple drag. That is, the cutting drill is dragged until it leaves the curving surface of the ball. Again, since dimple 3 starts with a circular dimple, minor axis A1 is the same as minor axis A1 of FIG. 3. The full dimple drag produces an elongated dimple 3 having major axis A3 which is greater than axis A2 of elongated dimple FIGS. 3A, 4A and 5A which are cross-sectional views taken along lines 3A, 4A, and 5A of FIGS. 3, 4, and 5 show the depth of the dimples of FIGS. 3, 4, and 5. The maximum depth D1, D2 and D3 occurs vertically below point C where the major and minor axes meet. Although varying depths may be selected, in the example below, all depths are equal. The selected depth is one of the parameters which controls the height of the trajectory of the ball.

EXAMPLE I

One example of a specific ball, as shown in FIG. 2, is as follows. This ball has a total of 332 dimples with substantially all of the dimples having the configuration as shown in FIGS. 4, 4A and 5, 5A. The outside diameter of the ball is substantially 1.68 inches.

| Dimple | Minor Axis | Major Axis | Number of Dimples | Dimple Depth |
|---|---|---|---|---|
| 2 | 0.074 in. | 0.088 in. | 220 | 0.0117 in. |
| 3 | 0.074 in. | 0.140 in. | 100 | 0.0117 in. |

As discussed above, there are ten (10) elliptical core dimples and two (2) circular polar vent dimples. This dimple pattern results in a ball having a surface dimple coverage of substantially 77%.

Figure 6:
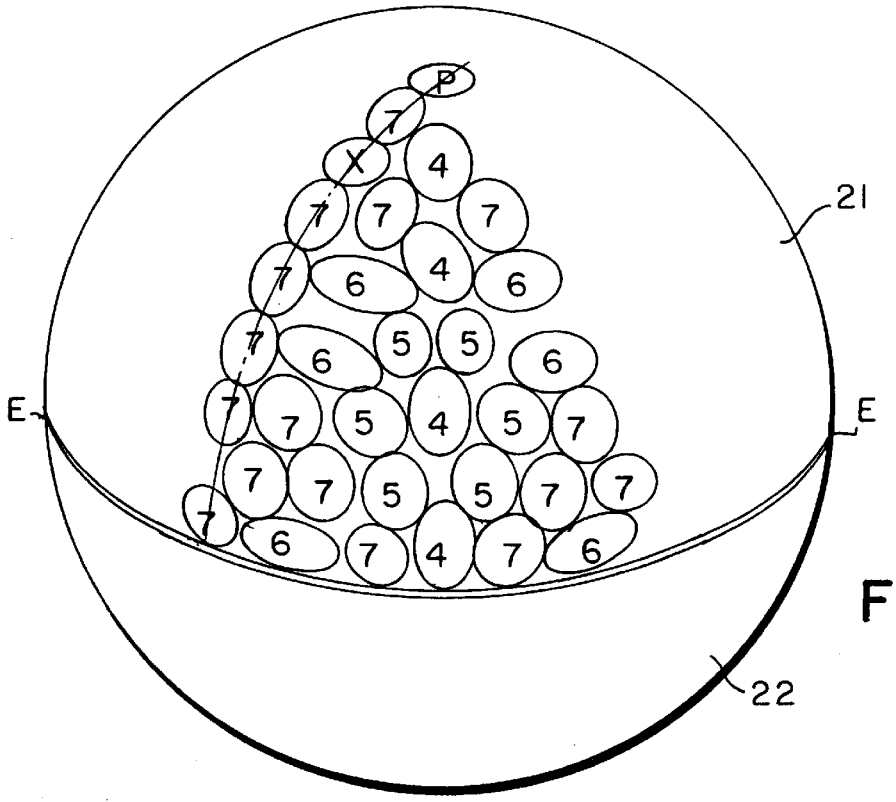
FIG. 6 is a perspective off-equator view showing a modified basic elongated dimple pattern section which is repeated about the surface of the ball.

FIG. 6 is a perspective off-equator view of a modified basic elongated dimple pattern which comprises four different sizes of elongate dimples 4, 5, 6, and 7. Elongated dimples 4 and 5 are formed starting with a dimple depression having the same diameter. Elongated dimples 6 and 7 are formed starting with a dimple depression having a different diameter than the dimple depression used for elongated dimples 4 and 5.

Using the basic illustrations of FIGS. 4 and 5 as applied to FIG. 6, dimples 4 and 5 have a minor axis A1. Dimple 4 has a full dimple drag resulting in a major axis A3. Dimple 5 has a partial dimple drag resulting in a major axis A2. As shown in FIGS. 7, 7A, 8 and 8A, dimples 6 and 7 have a minor axis A1'. Dimple 6 has a full dimple drag resulting in major axis A3'. Dimple 7 has a partial dimple drag resulting in a major axis A2'<A3. Thus dimples 4 and 5 have a minor axis A1 and dimples 6 and 7 have a minor axis A1'. Axis A1 differs from axis A1' since two different diameter dimple depressions are used. This forms a final pattern having four different size elongated dimples with substantially no dimple overlap wherein the sum of the major and minor axes differs in the four different elongated dimples. Again, the pattern of FIG. 6 is repeated in each hemisphere 21 and 22 so as to provide the finished ball as shown in FIG. 9.

EXAMPLE 2

Figure 9:
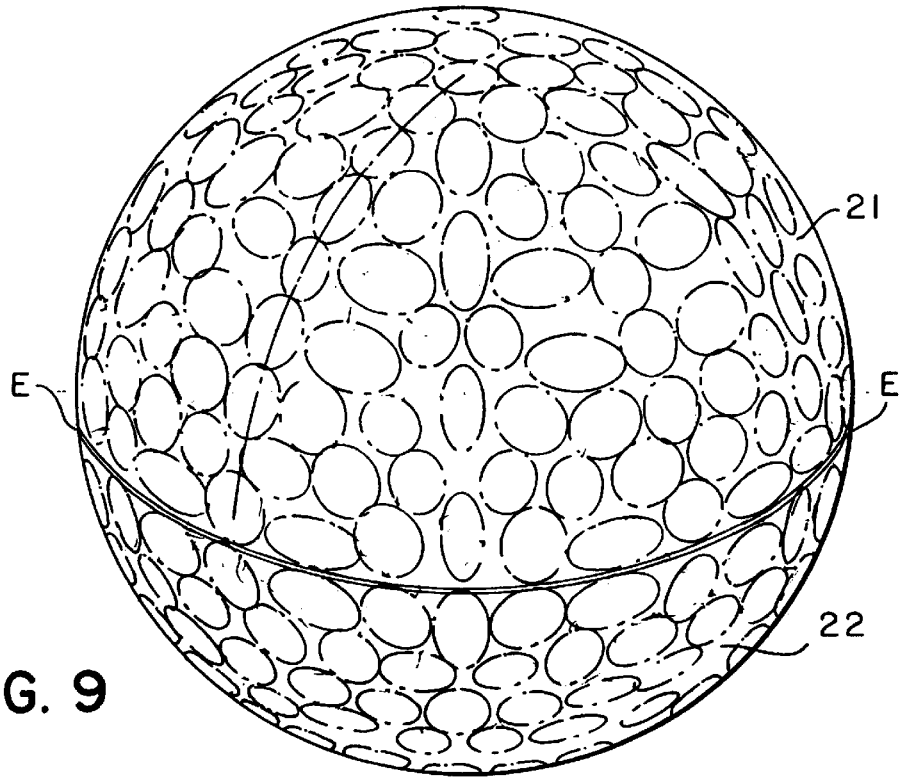
FIG. 9 is a perspective off-equator view showing a finished ball incorporating the pattern of FIG. 6.
Figure 8A:
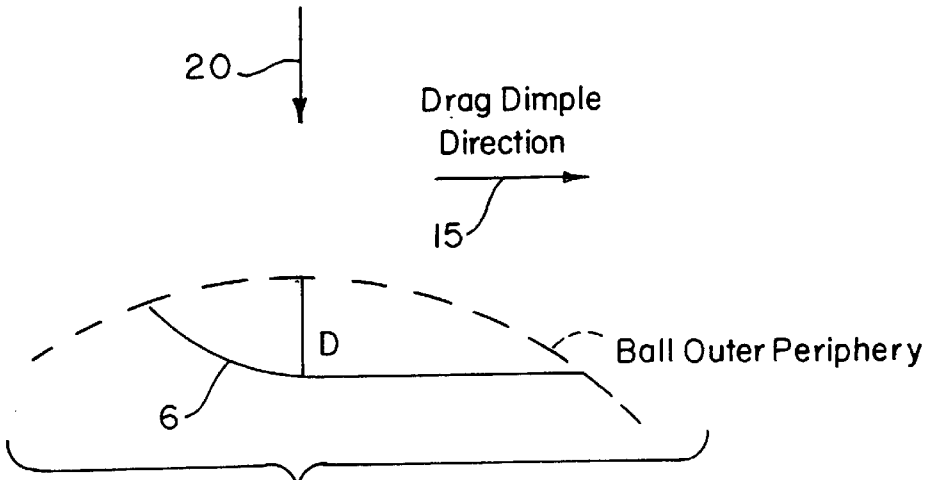
FIGS. 8 and 8A show a plan and cross-sectional view of a further elongated dimple formed by having a full dimple drag.
Figure 8:
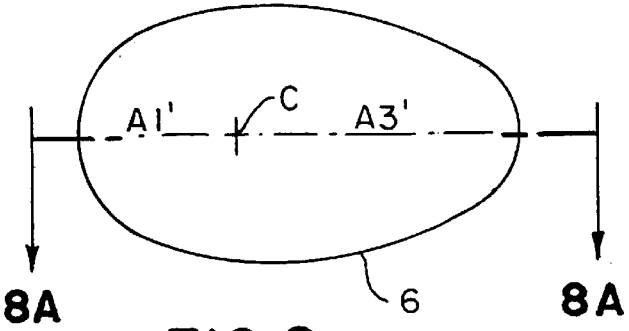

One example of a specific ball using the pattern of FIGS. 6 and 9 is as follows. This ball has a total of 332 dimples with substantially all of the dimples having an elongated configuration. This specific ball has an outside diameter of substantially 1.68 inches. Elongated dimples 4 and 6 are produced with a full dimple drag while dimples 5 and 7 are produced with a partial dimple drag. This ball provides a dimple coverage of substantially 75%.

| Dimple | Major Axis Length | Number of Dimples | Diameter | Depth |
|---|---|---|---|---|
| 4 Full | 0.1403 in. | 40 | 0.1400 in. | 0.0117 in. |
| 5 Partial | 0.0846 in. | 60 | 0.1400 in. | 0.0117 in. |
| 6 Full | 0.1403 in. | 60 | 0.1480 in. | 0.0117 in. |
| 7 Partial | 0.0880 in. | 160 | 0.1480 in. | 0.0117 in. |
| P&X Ellip/Cir | 0.0740 in. | 12 | 0.1480 in. | 0.0117 in. |

Figure 10:
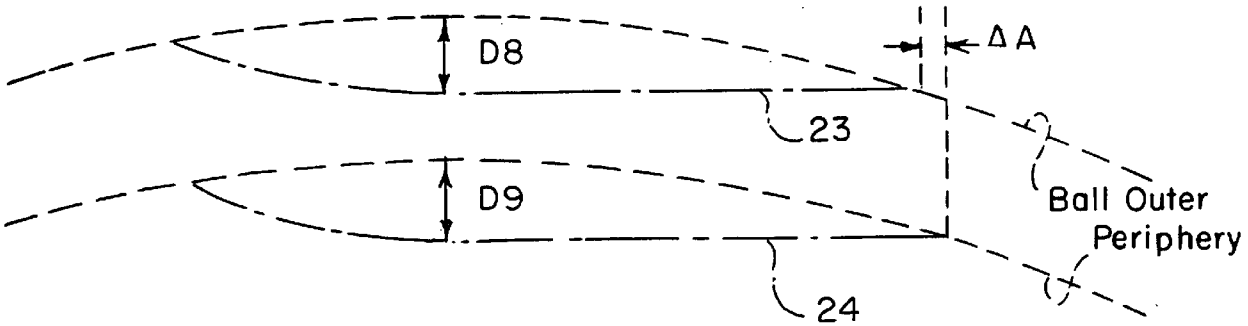
FIG. 10 is an enlarged cross-sectional view comparing dimples of different depths.

The selected depth of the original dimple depression is directly related to the length of the longitudinal axis of the elongated dimple resulting from dimple drag. This relationship is illustrated in FIG. 10 which shows an elongated view of the cross section of elongated dimples having different maximum depths. These dimples are produced with full dimple drag. Elongated dimple 23 has a maximum depth D8 which is less than the maximum depth of dimple D9 of dimple 24. This results in a difference ΔA in the total axis length of the two dimples.

Although the golf ball of the present invention could be produced by drilling each ball, such a procedure is not economically feasible. A procedure which has become standard in the industry is disclosed in U.S. Pat. No. 3,831,423 to Brown et al, issued Aug. 27, 1994. In this procedure, a hob is made of approximately the same dimensions as half of the finished golf ball and then a mold is formed from the hob.

Figure 13:
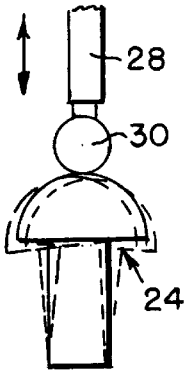
FIGS. 11–13 are plan views, respectively, showing different techniques for drilling elongated dimples into a spherical surface according to a further embodiment of the invention.
Figure 12:
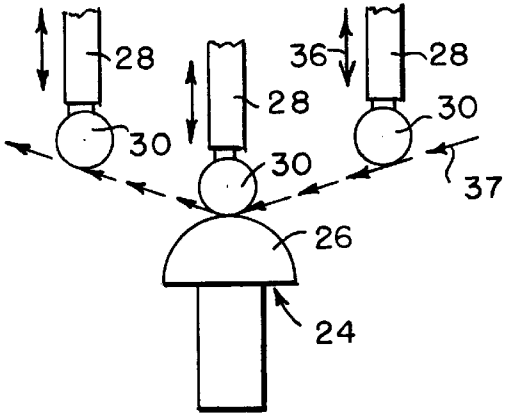
Figure 11:
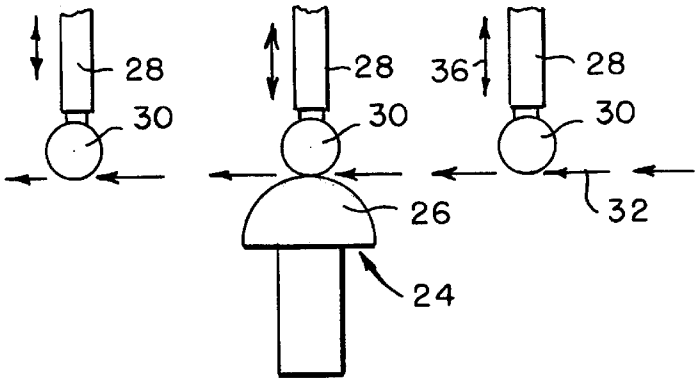

Referring now to FIGS. 11–13, alternate methods for drilling a hob 24 in accordance with further embodiments of the invention will now be described.

Figure 14:
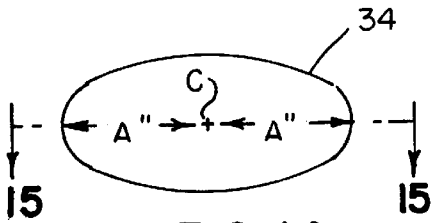
FIGS. 14 and 15 are plan and sectional views of a dimple formed with displacement relative to a cutting tool in a straight line.
Figure 15:
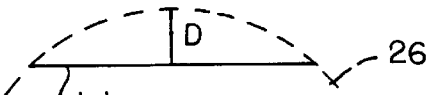

The hob has a hemispherical surface 26 which represents the outer surface of a golf ball. A cutting tool 28 is arranged adjacent the hob and includes a drill bit 30 having a first radius. In the embodiment of FIG. 11, the hob is fixed and the drill bit is displaced along a straight line represented by the arrows 32. When the drill bit strikes the hob surface, it cuts a dimple therein as it traverses the surface. Such a dimple 34 is shown in FIG. 14. It is elongated because of the curvature of the surface and includes a center C along a radius of the hob. The center is also equidistant from the opposite edge of the dimple. The dimple has equal major axes A" which are co-linear with the straight line of movement of the cutting tool 28. The depth D of the dimple (FIG. 15) is defined by the degree to which the cutting tool cuts into the hob along the radius thereof. The depth is adjustable by vertically displacing the cutting tool as shown by the arrows 36. Because the cutting tool moves along a straight line, the deepest portion of the dimple is also defined by a straight line L1 extending between the portions of the hob surface where the drill bit enters and leaves the same as shown in FIG. 15.

In lieu of displacing the cutting tool relative to the fixed hob, the same results can be achieved by fixing the tool and displacing the hob in a straight line.

Figure 16:
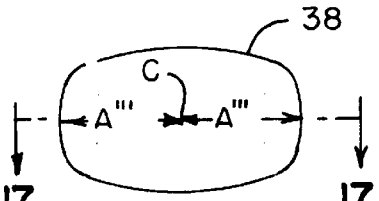
FIGS. 16 and 17 are plan and sectional views of a dimple formed with displacement relative to a cutting tool in a curved line.
Figure 17:
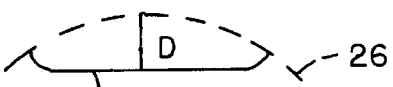

FIG. 12 represents a further embodiment for cutting a hemispherical surface on a hob. In this embodiment, the cutting tool moves along a curved path represented by the arrows 37. Thus, during the period which the drill bit 30 engages the surface 26 of the hob 24, the bit enters the hob with a lateral downward movement and exits the hob with a lateral upward movement as shown in FIG. 12. The resulting elongated dimple 38 is shown in FIGS. 16 and 17. It is elongated but blunted at the ends thereof in comparison with the dimple 34 of FIGS. 14 and 15. This is because of the angle at which the drill bit enters and leaves the hob. Thus, as shown in FIG. 17, the deepest portion of the dimple defines a line L2 which is curved at its opposite ends. The dimple 38 also has equal major axes A'''.

FIG. 13 shows an alternate embodiment for producing a dimple 38 configured as in FIGS. 16 and 17. The cutting tool 28 is stationary and the hob 24 is pivotable through an arc with respect to the drill bit.

Figure 18:
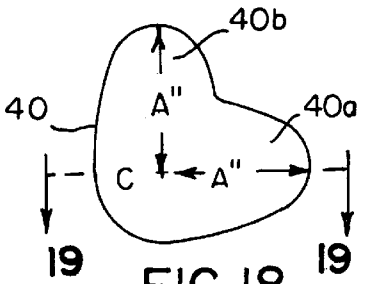
FIGS. 18 and 19 are plan and sectional views of a dimple formed with displacement relative to a cutting tool in two different straight directions.
Figure 19:
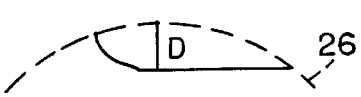

The description of FIGS. 11–13 above is for a cutting tool or hob being displaced within a plane in a first direction to produce the dimples 34 or 38 of FIGS. 14 and 16. It is also possible to displace the cutting tool or hob in a second plane during drilling to produce a dimple whose major axes are not co-linear. Such a dimple 40 is shown in FIGS. 18 and 19 and has a kidney-shaped configuration.

By way of example only, the dimple 40 has first and second semi-elliptical portions 40*a* and 40*b*. The portion 40*a* has a major axis A" and is formed in the same manner as the first half of the dimple 34 of FIG. 14. However, when the center of the drill bit reaches the center C of the dimple (which is along a radius of the hob), so that the radius of the hob and the axis of the cutting tool are aligned, the cutting tool is redirected for movement in a second direction or plane to form the portion 40*b* which also has a major axis A". Thus, the major axes intersect rather than being co-linear.

It will be appreciated by those skilled in the art that an infinite number of elongated dimple configurations are possible by using the drilling methods described above. Variable dimple depths—within a single dimple—are available by extending or retracting the cutting tool relative to the hob during the drilling step. Moreover, the direction of travel of the cutting tool relative to the hob can be reoriented through a number of planes during drilling.

While in accordance with the provisions of the patent statutes the preferred forms and embodiments have been illustrated and described, it will be apparent to those of ordinary skill in the art that various changes may be made without deviating from the inventive concepts set forth above.

What is claimed is:

1. A golf ball, comprising (a) a spherical surface containing a pole in each hemisphere thereof and an equator midway between said poles; and (b) a plurality of non-circular dimples arranged in said surface, each of said dimples having at least two equal axes, said axes intersecting and being arranged at an angle to define a kidney shaped dimple.

2. A golf ball, comprising (a) a spherical surface containing a pole in each hemisphere thereof and an equator midway between said poles; and (b) a plurality of non-circular dimples arranged in said surface, each of said dimples having at least two equal axes, said axes intersecting, wherein said dimples comprise at least two groups of dimples, a first group having axes which overlap to define elliptical dimples and a second group having axes arranged at an angle to define kidney-shaped dimples.

3. A golf ball as defined in claim 2, and further comprising a third group of dimples having axes which overlap an amount different from said first group, whereby two groups of elliptical dimples are defined with different lengths.

4. A dimple arranged in a spherical surface of a golf ball, said dimple including at least two equal axes which intersect, said axes being arranged at an angle, thereby to define a kidney-shaped dimple.

* * * * *